US011891883B2

(12) United States Patent
Dahms

(10) Patent No.: US 11,891,883 B2
(45) Date of Patent: Feb. 6, 2024

(54) WAVE MANIPULATOR FOR USE IN ELECTROHYDRAULIC FRACTURE STIMULATIONS

(71) Applicant: ExxonMobil Technology and Engineering Company, Annandale, NJ (US)

(72) Inventor: Rainer N. Dahms, Florham Park, NJ (US)

(73) Assignee: ExxonMobil Technology and Engineering Company, Annandale, NJ (US)

( * ) Notice: Subject to any disclaimer, the term of this patent is extended or adjusted under 35 U.S.C. 154(b) by 73 days.

(21) Appl. No.: 17/455,950

(22) Filed: Nov. 22, 2021

(65) Prior Publication Data

US 2022/0170356 A1 Jun. 2, 2022

Related U.S. Application Data

(60) Provisional application No. 63/119,165, filed on Nov. 30, 2020.

(51) Int. Cl.
*E21B 43/26* (2006.01)

(52) U.S. Cl.
CPC ..... *E21B 43/26* (2013.01)

(58) Field of Classification Search
CPC ..... E21B 43/26; E21B 43/114
See application file for complete search history.

(56) References Cited

U.S. PATENT DOCUMENTS

| | | | | |
|---|---|---|---|---|
| 4,479,680 | A * | 10/1984 | Wesley | E21B 43/26 166/299 |
| 7,059,403 | B2 * | 6/2006 | Arnoldo Barrientos | E21B 43/003 166/177.2 |
| 8,746,333 | B2 * | 6/2014 | Zolezzi-Garreton | E21B 43/003 166/177.6 |
| 10,145,969 | B2 * | 12/2018 | Moncho | G01V 1/52 |
| 10,400,567 | B2 * | 9/2019 | Liu | E21B 43/26 |
| 10,774,621 | B2 * | 9/2020 | Eng | E21B 28/00 |
| 10,865,622 | B2 * | 12/2020 | Fensky | E21B 37/00 |
| 11,293,735 | B2 * | 4/2022 | Magnotti | E21B 43/26 |
| 2014/0305877 | A1 * | 10/2014 | Cioanta | C09K 8/58 134/1 |
| 2019/0032454 | A1 * | 1/2019 | Barak | E21B 43/003 |
| 2020/0392805 | A1 * | 12/2020 | Kamler | E21B 28/00 |
| 2021/0301657 | A1 * | 9/2021 | Gordon | E21B 43/26 |

* cited by examiner

*Primary Examiner* — James G Sayre
(74) *Attorney, Agent, or Firm* — Vorys, Sater, Seymour and Pease LLP

(57) ABSTRACT

Methods for electrohydraulic fracture stimulation of formations may include producing an acoustic shock wave having a compressive wave character in a wellbore penetrating a formation and manipulating the acoustic shock wave. The acoustic shock wave may be manipulated in one or more of the following steps: channeling the acoustic shock wave down the wellbore to change a shape of the acoustic shock wave to less spherical; converting the compressive wave character to an expansion wave character; and changing an acoustic impedance of the acoustic shock wave. The acoustic shock wave having the changed shape, the expansion wave character, and the changed acoustic impedance is distributed into the formation.

18 Claims, 8 Drawing Sheets

WAVE MANIPULATOR FOR USE IN ELECTROHYDRAULIC FRACTURE STIMULATIONS

CROSS-REFERENCE TO RELATED APPLICATIONS

This application claims the benefit of U.S. Provisional Application No. 63/119,165 filed on Nov. 30, 2020, the entire contents of which are incorporated herein by reference.

FIELD OF THE INVENTION

The present disclosure relates generally to the field of stimulating of formations.

BACKGROUND OF THE INVENTION

Substantial volumes of hydrocarbons exist in low-permeability formations around the world. Examples of low-permeability formations include sandstone, carbonate, and shale. A variety of enhanced oil recovery (EOR) techniques have been developed to improve access to and production of hydrocarbons in low-permeability formations. One example is hydraulic fracturing where fissures and fractures in the formation are opened by introducing liquid at a high pressure. Generally, hydraulic fracturing introduces several large cracks in the formation.

Another new technique under development is electrohydraulic fracturing where a rapid arc discharge or plasma induced by the high voltage takes place in a liquid. The rapid expansion of the arc channel and liquid vaporization and expansion results in outward radiation in all directions of a strong acoustic shock wave. It is believed that when this technology is used in a wellbore for fracturing purposes, an acoustic shock wave propagates through a liquid-filled wellbore and into the surrounding formation. The shock wave should create fractures and microcracks in the surrounding formation. Some laboratory studies using a small, low-permeability rock sample have shown that electrohydraulic fracturing has the potential to increase the permeability by two orders of magnitude or more.

However, when implemented downhole, only a small fraction of the initial shock wave's energy is seemingly utilized for the creation of fractures and microcracks. For example, it is estimated 0.1% of the initial shock wave's energy actually penetrates the surrounding formation. For example, it is estimated electrohydraulic fracturing could cause fractures and microcracks 10 meters or more into low-permeability rock structures, but in practice, the fractures and microcracks are generally found only within feet of the wellbore.

SUMMARY OF THE INVENTION

The present disclosure relates to the field of stimulating of formations. More specifically, the present disclosure relates to systems and methods for electrohydraulic fracture stimulation of formations.

A method of the present disclosure comprises: producing an acoustic shock wave having a compressive wave character in a wellbore penetrating a formation; channeling the acoustic shock wave down the wellbore to change a shape of the acoustic shock wave to a quasi-planar shape; and distributing the acoustic shock wave having the changed shape into the formation.

Another method of the present disclosure comprises: producing an acoustic shock wave having a compressive wave character in a wellbore penetrating a formation; channeling the acoustic shock wave down the wellbore to change a shape of the acoustic shock wave to less spherical; converting the compressive wave character to an expansion wave character; changing an acoustic impedance of the acoustic shock wave; and distributing the acoustic shock wave having the changed shape, the expansion wave character, and the changed acoustic impedance into the formation.

A system of the present disclosure comprises: an electrohydraulic fracturing device capable of producing an acoustic shock wave; a wave manipulator coupled to the electrohydraulic fracturing device such that the acoustic shock wave enters the manipulator, wherein the wave manipulator comprises: a wave-focusing component capable of channeling the acoustic shock wave; and a wave distribution component.

Another system of the present disclosure comprises: an electrohydraulic fracturing device capable of producing an acoustic shock wave; a wave manipulator coupled to the electrohydraulic fracturing device such that the acoustic shock wave enters the manipulator, wherein the wave manipulator comprises: a wave-focusing component capable of channeling the acoustic shock wave; an acoustic impedance conversion component capable of changing an acoustic impedance of the acoustic shock wave; a wave converter component capable of converting a compressive wave character of the acoustic shock wave to an expansion wave character; and a wave distribution component.

BRIEF DESCRIPTION OF THE DRAWINGS

The following figures are included to illustrate certain aspects of the disclosure, and should not be viewed as exclusive configurations. The subject matter disclosed is capable of considerable modifications, alterations, combinations, and equivalents in form and function, as will occur to those skilled in the art and having the benefit of this disclosure.

DETAILED DESCRIPTION OF THE INVENTION

Figure 1:
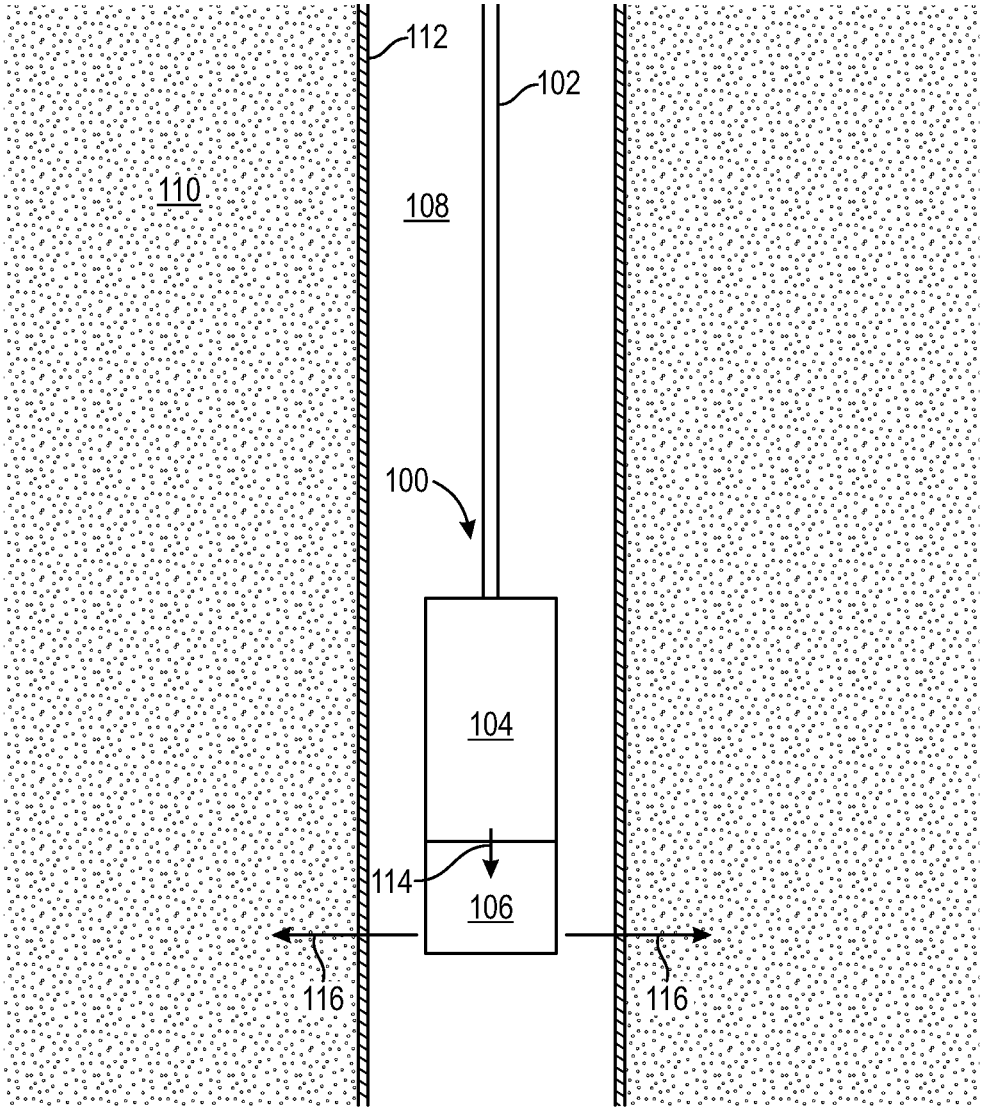
FIG. 1 illustrates a nonlimiting example of a wireline system comprising a wireline, an electrohydraulic fracturing device, and a wave manipulator of the present disclosure.

The present disclosure relates to the field of stimulating of formations. More specifically, the present disclosure relates to systems and methods for electrohydraulic fracture stimulation of formations. The systems and methods described herein address one or more of three factors that reduce the efficacy of electrohydraulic fracture devices downhole: (1) spherically radiating shape of the shock wave, (2) the compression wave character of the produced shock wave, and (3) the acoustic impedance difference between the fluid in the wellbore and the formation surrounding the wellbore.

First, the shock wave produced in an electrohydraulic fracturing device radiates spherically in all directions. Therefore, the energy of the shock wave is dispersed throughout the surrounding wellbore and formation, which in addition to the interaction of the shock wave with the surrounding components, minimizes the energy any one portion of the formation experiences. The systems and methods of the present disclosure may include aspects that focus the shock wave's energy to increase the penetration depth effects within the formation.

Second, the shock wave produced in an electrohydraulic fracturing device is a compression wave that applies compression stress (or a pushing effect) to the material in which the shock wave encounters. The systems and methods of the present disclosure may convert the compressive wave character of the shock wave to an expansion wave character. This translates to a tension stress (or a pulling effect) for the material in which the converted shock wave encounters. For a low-permeability formation, tension stress causes more damage and microcracking than compression stress.

Third, in a downhole environment, the shock wave is produced in a device that is within a fluid-filled wellbore. The shock wave travels through the fluid before interacting with the surrounding formation and other components that may be present in the wellbore (e.g., the powertrain used to generate the shock wave, a casing, wellbore plugs, and the like, and any combination thereof). The fluid and the surrounding formation (or casing, if present) have very different acoustic impedances. The difference in acoustic impedances causes only a small portion of the energy of the shock wave to transfer to the formation. The majority of the energy is reflected back into the wellbore. The systems and methods of the present disclosure may use impedance-matching components of a shock wave that more closely matches the acoustic impedance of the formation to mitigate reflections.

Therefore, the systems and methods of the present disclosure use one or more of a variety of principles to improve the magnitude and efficacy of the energy transferred into the surrounding formation that was produced by the electrohydraulic discharge. Consequently, the magnitude and depth of the fracturing of said formation would be improved.

Definitions

As used herein, the term "formation" refers to any subsurface geologic formation that may or may not contain hydrocarbons.

As used herein, the term "quasi-planar wave" refers to a wave having a constant intensity +/−10% over any plane perpendicular to the direction the wave is traveling. The term "quasi-planar wave" encompasses a planar wave.

Electrohydraulic Fracture Stimulation Systems and Methods

FIG. 1 illustrates a nonlimiting example of wireline system 100 comprising a wireline 102, an electrohydraulic fracturing device 104, and a wave manipulator 106 of the present disclosure. The wireline system 100 is illustrated as being located within a wellbore 108 penetrating a formation 110 and having a casing 112.

The electrohydraulic fracturing device 104 is coupled to the wave manipulator 106 such that an acoustic shock wave 114 produced by the electrohydraulic fracturing device 104 is received by the wave manipulator 106. The wave manipulator 106 manipulates the acoustic shock wave 114 into a modified shock wave 116 and distributes the modified shock wave 116 into the formation 110.

Manipulation of the acoustic shock wave 114 may include one or more of: changing the shape of the acoustic shock wave 114, converting the compressive wave character of the acoustic shock wave 114, and changing the acoustic impedance of the acoustic shock wave 114.

An electrohydraulic fracturing device produces a strong, quasi-spherical propagating acoustic shock. Acoustic potential energy conservation dictates that the shock's peak pressure must scale nearly inversely proportional to the propagation distance R. Simulations were performed for quantifying the pressure evolution with propagation distance of a spherically-expanding acoustic shock wave using the Department of Energy detonation code CMT-Nek. The observed shock dispersion inherently limits the attainable reach of the electrohydraulic fracture stimulation to the near-borehole-region because the acoustic shock wave is rendered ineffective once the shock wave's induced stresses no longer overcome the in-situ stress constraints of the reservoir. Hence, this naturally present $R^{-1}$-stress scaling is an inherent limiter to far-reaching, large-scale rock fracturing. An increase of the electrohydraulic energy deposition and initially generated acoustic shock intensity may not be the most effective way to extend the shock wave's propagation distance where sufficient stresses still exist. Further, the stresses near the borehole casing unnecessarily far exceed those required to induce rock fracturing. Hence, an otherwise desirable increase in the electrohydraulic energy deposition is limited so to not compromise the casing's integrity instead to fracturing the formation.

To overcome this hurdle, the present disclosure includes components that change the shape of the acoustic shock wave from a quasi-spherical shape to a quasi-planar shape that propagates down the wellbore. This reduces geometric dispersion of the energy of the shock wave.

Figure 2:
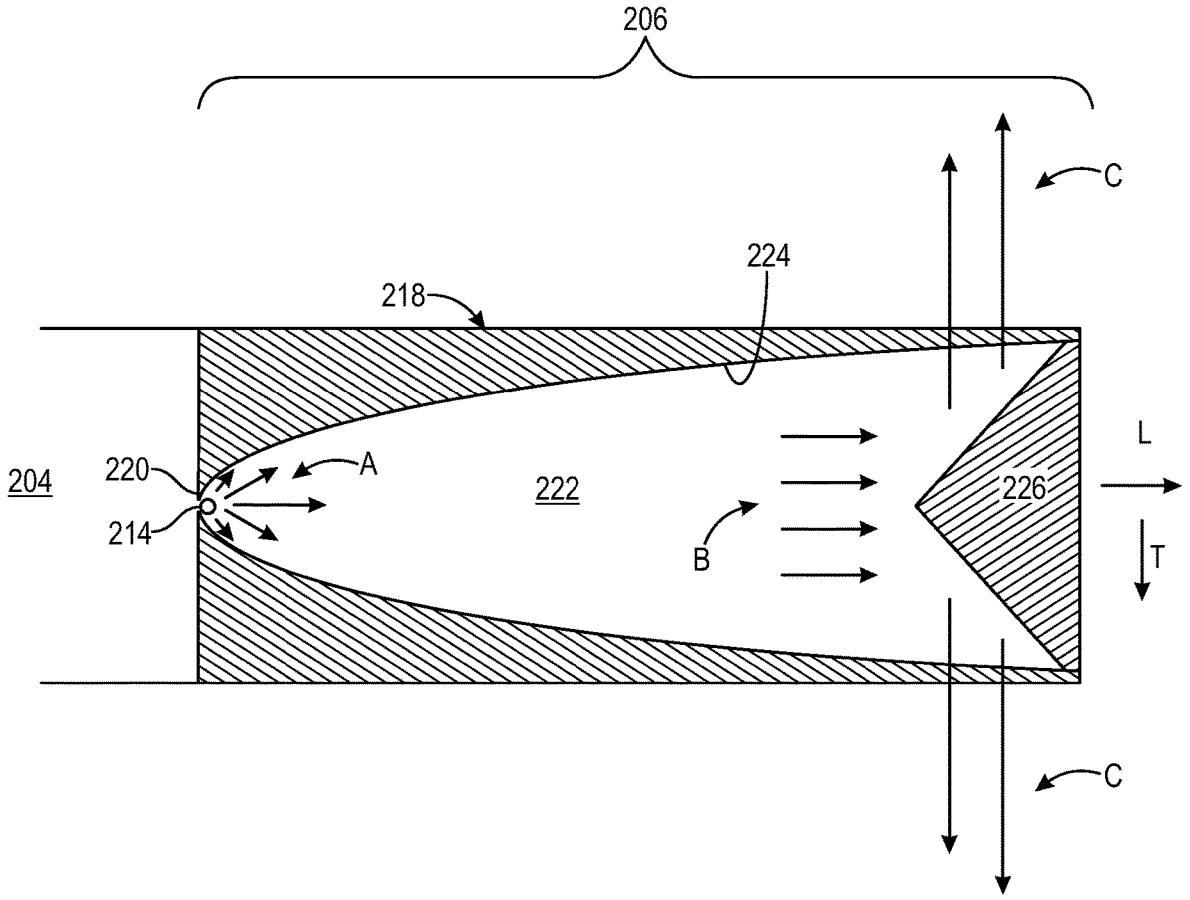
FIG. 2 illustrates a nonlimiting example of an electrohydraulic fracturing device coupled to a wave manipulator.

FIG. 2 illustrates a nonlimiting example of an electrohydraulic fracturing device 204 coupled to a wave manipulator 206. In this example, the wave manipulator 206 manipulates the acoustic shock wave 214 by changing the shape of the acoustic shock wave 214. The wave manipulator 206 then distributes a modified shock wave to the surrounding area.

Referring again to FIG. 2, the illustrated wave manipulator 206 includes a wave-focusing component 218 having an opening 220 at first end proximal to the electrohydraulic fracturing device 204. The acoustic shock wave 214 is received from the electrohydraulic fracturing device 204 at the opening 220. Here, the acoustic shock wave 214 is radiating in all directions illustrated, at least in part, by arrows A. The acoustic shock wave 214 is preferably created by the electrohydraulic fracturing device 204 at the opening 220 or directed to the opening 220 so that a significant portion (about 50% or more, or about 60% or more, or about 70% or more, or about 80% or more, or about 90% or more, or about 95% or more, or about 99% or more) of the energy of the acoustic shock wave 214 is in the wave-focusing component 218.

Extending from the opening 220 along the longitudinal direction L of the wave manipulator 206 away from the electrohydraulic fracturing device 204, the wave-focusing component 218 has a cavity 222 that tapers from a smaller diameter to a larger diameter. The cavity 222 has a wall 224 formed of a reflective material. In this illustration, the wall 224 is a solid piece from inside to out and forms the tapering itself. However, other configurations may include (a) a solid piece formed of a first material that forms the tapering and (b) a wall (or coating or layer) on an inside of the tapering formed of the reflective material.

The cavity 222 is filled with an acoustic shock wave transmitting fluid. Suitable acoustic shock wave transmitting fluids include those used in electrohydraulic fracturing devices and is preferably the fluid used in the electrohydraulic fracturing device 204. Typically, water is used as the acoustic shock wave transmitting fluid. However, other suitable fluids may be used.

The tapering of the cavity 222 may be conical, ellipsoidal conical (as illustrated), stepped, or any other suitable shape to change the shape of the acoustic wave 214.

Reflective materials for use as the wall 224 of the cavity 222 should reflect the shock wave and have a strength sufficient to withstand the shock wave's intensity close to the origin of the shock wave formation. Examples of reflective materials suitable for use as the wall 224 of the cavity 222 include, but are not limited to, tungsten, steel, and the like, and any combination thereof. Said combinations may be alloys or admixes.

The tapering of the cavity 222 and the reflective material of the wall 224 together reshape the acoustic shock wave 214 from radiating in many directions to focusing along the longitudinal direction L as illustrated by arrows B.

In this illustrated example, only the shape of the acoustic wave 214 is changed. Therefore, the modified shock wave is at least partially illustrated by arrows B.

The wave manipulator 206 also includes a wave distribution component 226 at a distal portion of the wave manipulator 206 from the electrohydraulic fracturing device 204. The wave distribution component 226 changes the direction of the modified shock wave to distribute the modified shock wave from direction B into direction C. The wave distribution component 226 has a surface 224 formed of a reflective material. In this example, the wave distribution component 226 is formed of the reflective material. However, other configurations may include (a) a solid piece formed of a first material that forms the shape of the wave distribution component 226 and (b) a coating or a layer on the wave distribution component 226 formed of the reflective material.

Without being limited by theory, distribution of the modified shock wave from direction B into direction C manner focuses the shockwave, which may greatly reduce reflections of the shock wave's energy. That is, in the current technologies that implement the distributed shock wave, some of the shock wave's energy encounters the casing or rock at an angle that allows for the energy to be reflected along the liquid-casing-rock interface (or liquid-rock interface). In contrast, the present focusing and directing of the shock wave may mitigate these reflections and, consequently, the total internal reflections experienced at the liquid-casing-rock interface (or liquid-rock interface).

In FIG. 2, the wave distribution component 226 is illustrated as being at least partially within the cavity 222 of the wave-focusing component 218. Alternatively, the wave distribution component 226 may be situated apart from the wave-focusing component 218 along the longitudinal direction L. In such instances, a connector may be used to contain the shock wave as the shock wave propagates from the wave-focusing component 218 to the wave distribution component 226. Preferably, the connector has the same internal diameter and cross-sectional shape as the portion of the cavity 222 closest to the wave distribution component 226.

Example of reflective materials suitable for use in the wave distribution component 226 include, but are not limited to, a magnesium alloy, high-strength aluminum alloy, aluminum-lithium alloy, copper-base alloy, steel, tungsten, and the like, and any combination thereof. Said combinations may be alloys or admixes.

In a preferred example, the acoustic wave 214 is reshaped to a quasi-planar shape along the longitudinal direction L in the wave-focusing component 218 and distributed in a transverse direction T (+/−30°) by the wave distribution component 226. The shape of the wave distribution component 226 can be used to direct the modified shock wave.

Figure 3A:
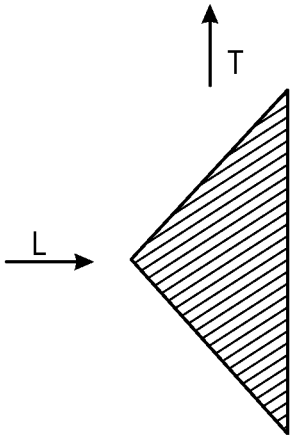
FIGS. 3A and 3B illustrate an example shape of a wave distribution component of the present disclosure in cross-sectional view and top view, respectively.
Figure 3B:
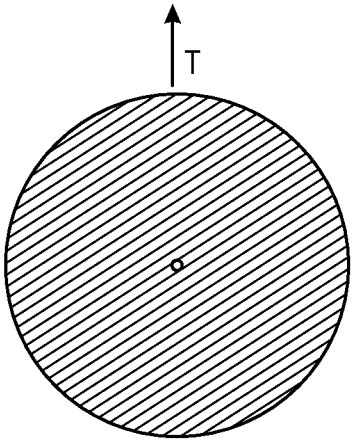
Figure 4A:
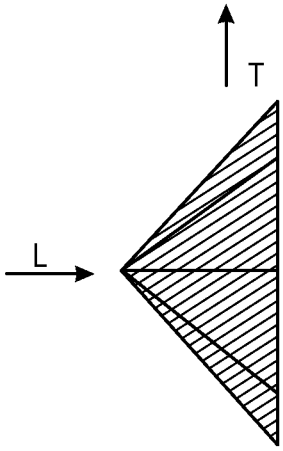
FIGS. 4A and 4B illustrate another example shape of a wave distribution component of the present disclosure in cross-sectional view and top view, respectively.
Figure 4B:
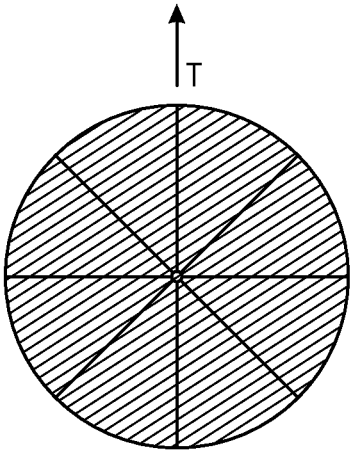
Figure 5A:
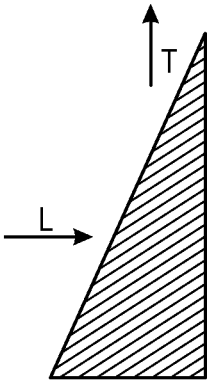
FIGS. 5A and 5B illustrate yet another example shape of a wave distribution component of the present disclosure in cross-sectional view and top view, respectively.
Figure 5B:
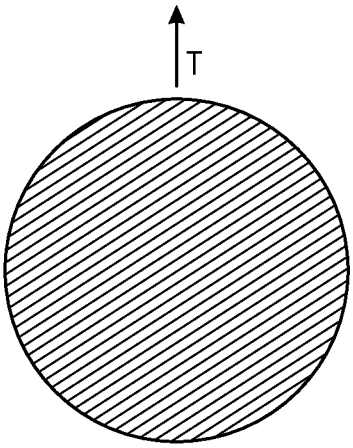

For example, FIGS. 3A and 3B illustrate a smooth, conical shape in cross-sectional view and top view, respectively, for a wave distribution component of the present disclosure. In another example, FIGS. 4A and 4B illustrate a facetted, conical shape in cross-sectional view and top view, respectively, for a wave distribution component of the present disclosure. In yet another example, FIGS. 5A and 5B illustrate a smooth, wedged shape in cross-sectional view and top view, respectively, for a wave distribution component of the present disclosure. Other shapes for the wave distribution component may be implemented.

Another cause for loss of energy in the acoustic shock wave is energy reflection after dispersion of the shock wave toward the casing and formation. For example, in FIG. 2, the modified shock wave traveling in direction C will encounter the water contained within the casing, a casing (if present), and then the formation.

Acoustic impedance of a material is the product of the material's density (p) and the speed of the sound waves traveling in the material (c). Because the acoustic shock wave 214 propagates through water in the cavity 222, the modified shock wave has an acoustic impedance of water (c=1430 m/s; p=1000 kg/m$^3$). The casing is typically made of cement (c=2800 m/s; p=1920 kg/m$^3$), and c=3600 m/s and p=2700 kg/m$^3$ are reasonable representative values for low-permeability formation rocks.

Continuing with the above-described simulations using CMT-Nek, a substantial portion of the acoustic energy is lost through reflections at the material interfaces encountered. The majority reflection is at the water-casing-rock interface (or water-rock interface, if no casing) because of the significant acoustic impedance differences between water and rock (or casing). Where a casing is not present, similar reflections are likely to be observed because of the differences between water and formation rocks. While the reflected energy will eventually enter the formation due to multiple back reflections, the simulations show that the intensity of such bifurcated shock waves is likely insufficient to fracture rock. Using different configurations, the simulations indicate that the range of reflected energies from impedance mismatch and total internal reflections of about 85% to about 90% of the incident acoustic shock wave energy is considered lost.

The wave manipulators of the present disclosure may include an acoustic impedance conversion component. The aim of this component is to increase the acoustic impedance of the acoustic shock wave before directing the shock wave toward the casing (if present) and formation.

Figure 6A:
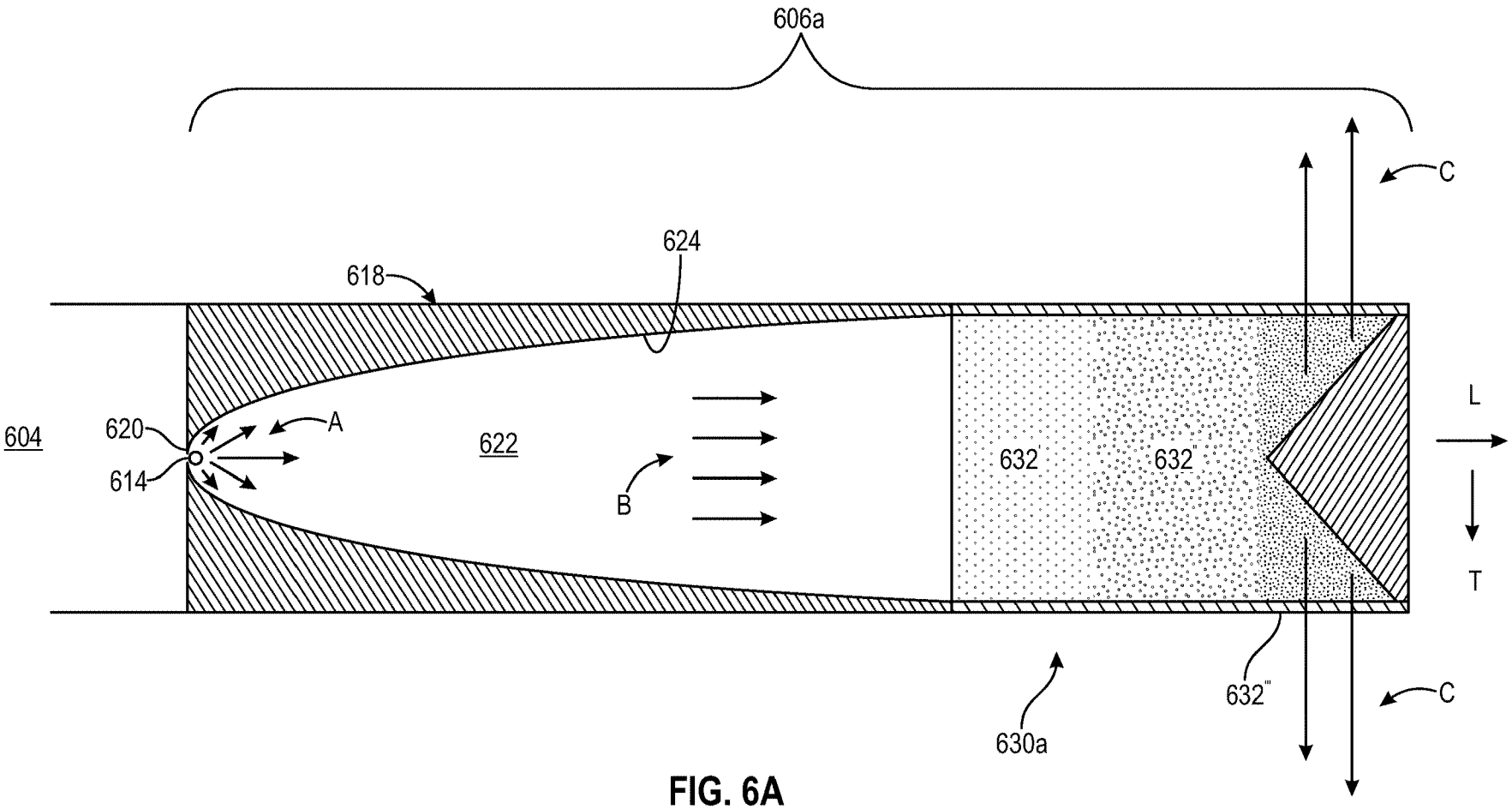
FIGS. 6A and 6B illustrate nonlimiting examples of an electrohydraulic fracturing device coupled to a wave manipulator.
Figure 6B:
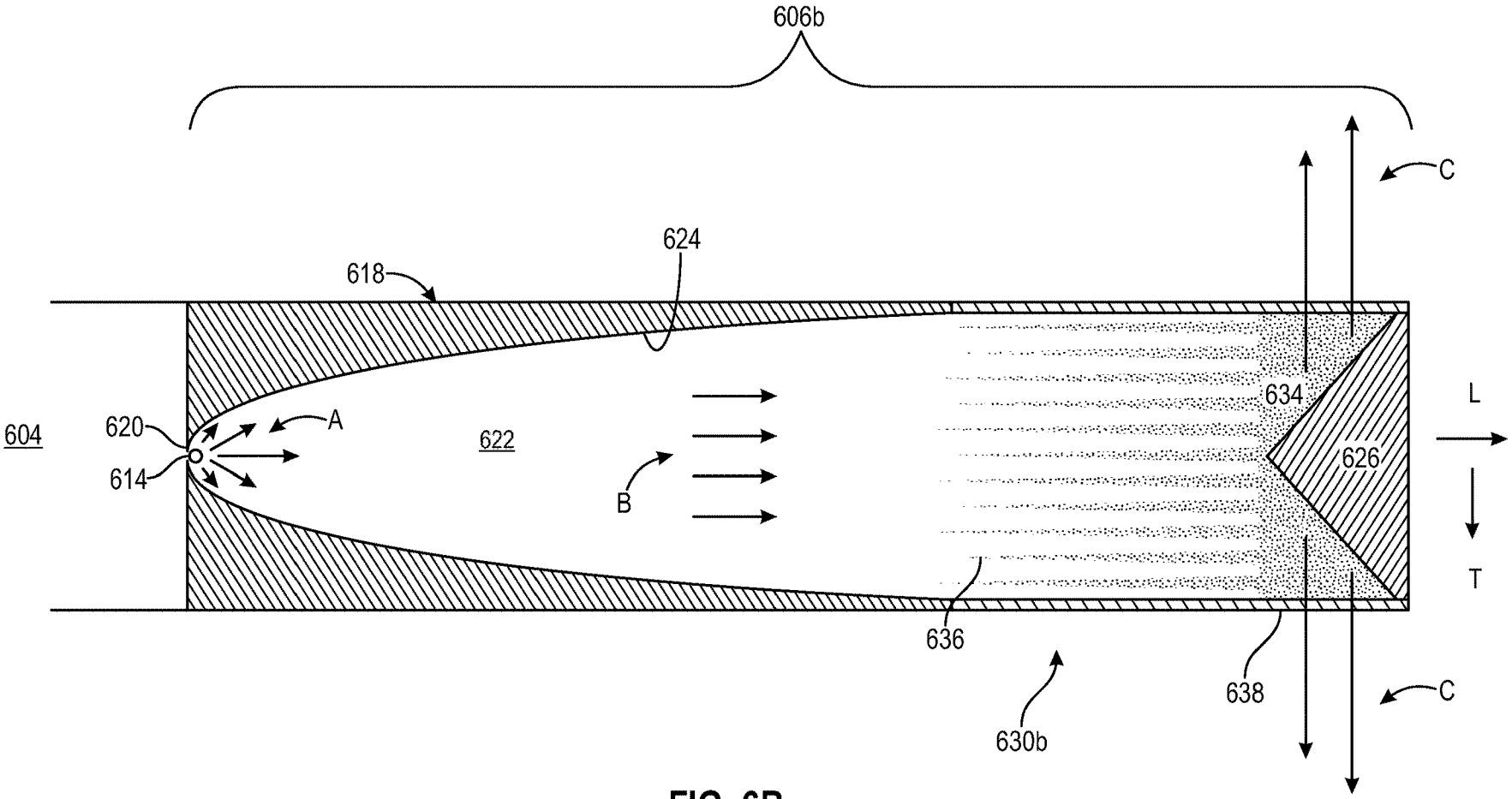

FIGS. 6A and 6B illustrate nonlimiting examples of an electrohydraulic fracturing device 604 coupled to a wave manipulator 606*a* and 606*b*, respectively. In this example, the wave manipulator 606 manipulates the acoustic shock wave 614 by (a) changing the shape of the acoustic shock wave 614 and (b) changing the acoustic impedance of the acoustic shock wave 614. The wave manipulator 606 then distributes a modified shock wave to the surrounding area (e.g., the formation).

The illustrated wave manipulator 606 includes a wave-focusing component 618 having an opening 620 at first end proximal to the electrohydraulic fracturing device 604. The wave-focusing component 618 functions as described for the wave-focusing component 218 of FIG. 2.

The acoustic shock wave 614 having a quasi-planar shape traveling in direction B then interacts with an acoustic impedance conversion component 630*a* or 630*b*. The acoustic impedance conversion component 630*a* or 630*b* increases the acoustic impedance of the acoustic shock wave 614. This may be achieved by passing the acoustic shock wave 614 through a suitable material having an acoustic impedance within about 20% (or within about 10%, or within about 5%) of the acoustic impedance of the casing or formation or both. Most simply, the material may be placed within the path of the acoustic shock wave 614 within the acoustic impedance conversion component. However, to mitigate energy losses, a progressive transition from lower to higher acoustic impedance is preferred. In such a progressive transition, the acoustic impedance of the acoustic shock wave 614 changes two or more times along the length of the acoustic impedance conversion component as the acoustic shock wave 614 travels through the acoustic impedance conversion component towards the wave distribution component 626. The progressive transition may be stepped (e.g., FIG. 6A) or continuous (FIG. 6B). Hybrids thereof are also suitable. FIGS. 6A and 6B illustrate two nonlimiting examples of how such a progressive transition may be achieved.

In FIG. 6A, the progressive transition from lower to higher acoustic impedance is achieved with layers 632', 632", 632'" of materials. In the illustrated example, the acoustic impedance of said materials would be layer 632'<layer 632"<layer 632'" where the acoustic impedance of layer 632'" is preferably within about 20% (or within about 10%, or within about 5%) of the acoustic impedance of the casing or formation or both. While FIG. 6A illustrates three layers, fewer or more layers may be used. Further, other configurations like gradient increases in acoustic impedance as the acoustic shock wave 614 traverses the acoustic impedance conversion component 630*a* may be used. The acoustic impedance conversion component 630*a* may use a combination of layers and gradients.

For example, polydimethylsiloxane-titanium dioxide composites may be used to achieve the illustrated layers 632', 632", 632'" and/or gradient. For example, the loading of titanium dioxide particles in a polydimethylsiloxane matrix may range from about 15 wt % to about 80 wt % within the acoustic impedance conversion component 630*a*, where higher wt % titanium dioxide loading yield a higher acoustic impedance.

In FIG. 6B, the progressive transition from lower to higher acoustic impedance is achieved with the shape of a material 634 having an acoustic impedance within about 20% (or within about 10%, or within about 5%) of the acoustic impedance of the casing or formation or both. Illustrated are tapered spikes 636 composed of the material 634 where the tips or points of the spikes are proximal to the wave-focusing component 618. The spikes 636 increase in cross-sectional area as the spikes 636 approach the wave distribution component 626. In the illustrated example, the spikes 636 come together at a base 638 that contacts a surface of the wave distribution component 626.

In this example, the water (or other acoustic shock wave transmitting fluid) in the cavity 622 also is within the interstitial spaces between the spikes 636. Without being limited by theory, it is believed that the acoustic impedance of each cross-section scales with the volume ratio between water and spike material. Hence, closer to the wave-focusing component 618 where a cross-section has a higher volume fraction of water than the spike material, the acoustic impedance is minimally changed from water. Approaching the wave distribution component 626, the volume fraction of water continuously decreases while the volume fraction of the spike material simultaneously increases. Again, without limitation of theory, the acoustic impedance may smoothly increase as the shock wave approaches the wave distribution component 626. The size and shape of the spikes 636 may depend on the wavelength(s) present in the shock wave.

Examples of materials 634 include, but are not limited to magnesium alloys, high-strength aluminum alloys, aluminum-lithium alloys, copper-base alloy, polydimethylsiloxane-titanium dioxide composite, and the like, and any combination thereof.

While FIG. 6B the acoustic impedance conversion component 630*b* uses spikes 636 to facilitate the change in acoustic impedance, other shapes or configurations may be used.

In both of FIGS. 6A and 6B, the shape and acoustic impedance of the acoustic wave 614 are changed. The resultant modified shock wave is then distributed to the surroundings (e.g., the formation) in a transverse direction T (+/−30°) illustrated by arrows C by the wave distribution component 626. The various alternative configurations for the wave distribution component 226 are also applicable to the wave distribution component 626.

The third modification to the acoustic shock wave is to convert the compressive wave character to an expansion wave character. As described herein, the acoustic shock wave produced in an electrohydraulic fracturing device is a compression wave. Compression waves apply compression stress (or a pushing effect) to the material in which the shock wave encounters. The systems and methods of the present disclosure may use a solid-gas interface at the wave distribution component to convert the compressive wave character of the shock wave to an expansion wave character, which is, at least in part, due to the density difference between the solid and the gas. Further, reflection laws dictate that the direction of the reflected wave is not additionally changed only because a conversion from compressive to tensile wave has occurred. Therefore, a simultaneous conversion of a compressive wave character into an expansion wave character and distribution of the shock wave occurs. The expansion wave character translates to a tension stress (or a pulling effect) for the material in which the converted shock wave encounters. For a low-permeability formation, tension stress causes more damage and microcracking than compression stress.

Figure 7:
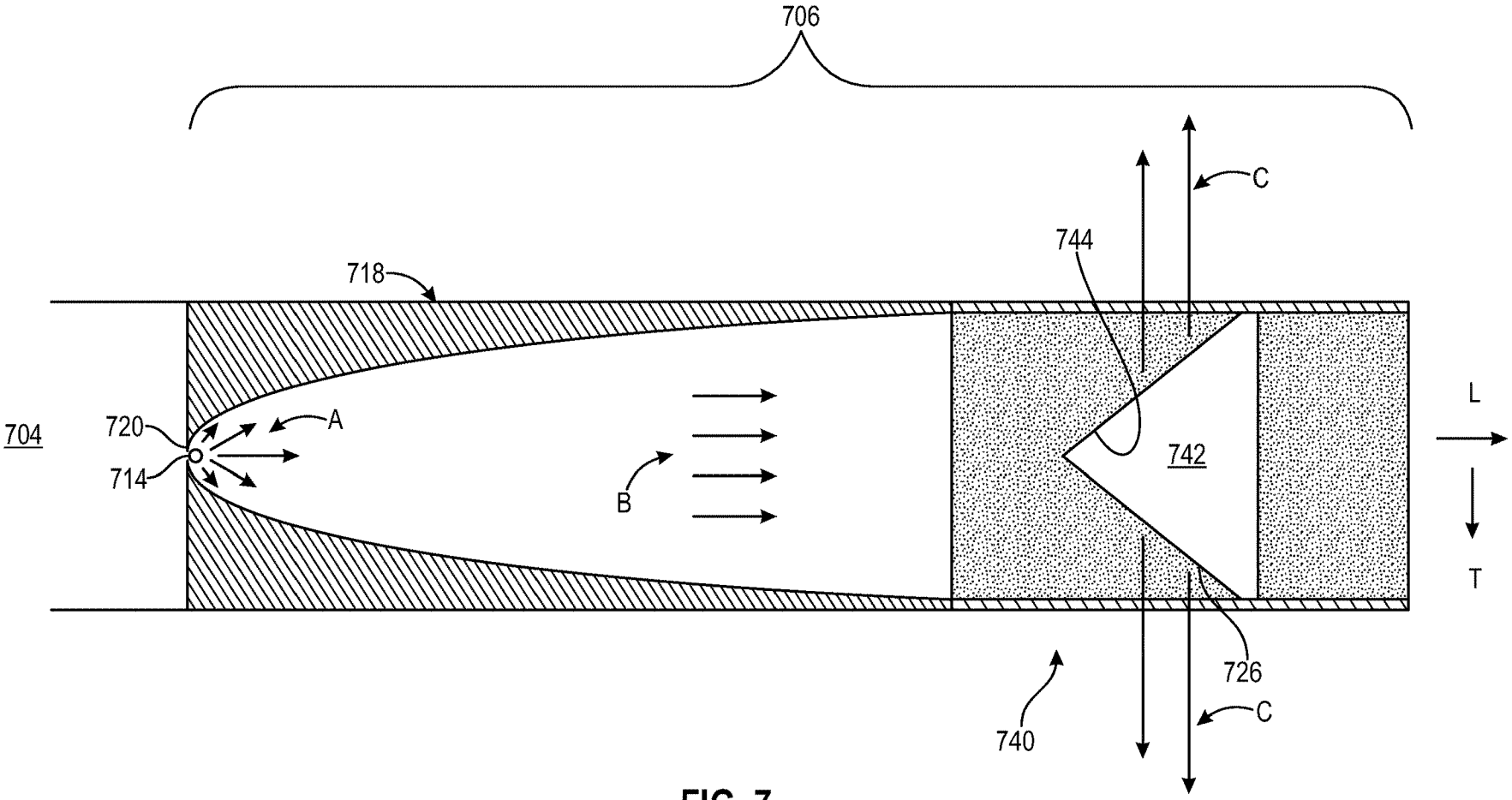
FIG. 7 illustrates another nonlimiting example of an electrohydraulic fracturing device coupled to a wave manipulator.

FIG. 7 illustrates a nonlimiting example of an electrohydraulic fracturing device 704 coupled to a wave manipulator 706. In this example, the wave manipulator 706 manipulates the acoustic shock wave 714 by (a) changing the shape of the acoustic shock wave 714 and (b) converting the compressive wave character of the acoustic shock wave 714 to an expansion wave character. The wave manipulator 706 then distributes a modified shock wave to the surrounding area (e.g., the formation).

The illustrated wave manipulator 706 includes a wave-focusing component 718 having an opening 720 at first end proximal to the electrohydraulic fracturing device 704. The wave-focusing component 718 functions as described for the wave-focusing component 218 of FIG. 2.

The acoustic shock wave 714 having a quasi-planar shape traveling in direction B then interacts with a wave converter component 740. The wave converter component 740 includes a cavity 742 comprising gas, which creates a solid-gas interface 744 that converts the compressive wave character of the acoustic shock wave 714 to an expansion wave character. The gas in the cavity 742 may be at greater than ambient pressure (e.g., a compressed gas), ambient pressure, or reduced pressure. Alternatively, a true vacuum may be present in the cavity 742, where the disclosure herein of a solid-gas interface would become a solid-vacuum interface. Preferably, the cavity 742 comprises gas at a reduced pressure to mitigate reductions in energy of the acoustic shock wave 714 due to energy being absorbed and/or passing through the gas.

The solid-gas interface 744 acts like a reflective material to distribute the shock wave 714 into the formation, which is the wave distribution component 726. Suitable reflective materials for the wave distribution component 726 are those described relative to the wave distribution component 226.

Therefore, the shape and compressive character of the acoustic wave 714 are changed to a quasi-planar and an expansion character. The resultant modified shock wave is then distributed to the surroundings (e.g., the formation) in a transverse direction T)(+/−30° illustrated by arrows C by the wave distribution component 726. The various alternative configurations for the wave distribution component 226 are also applicable to the wave distribution component 726.

Figure 8A:
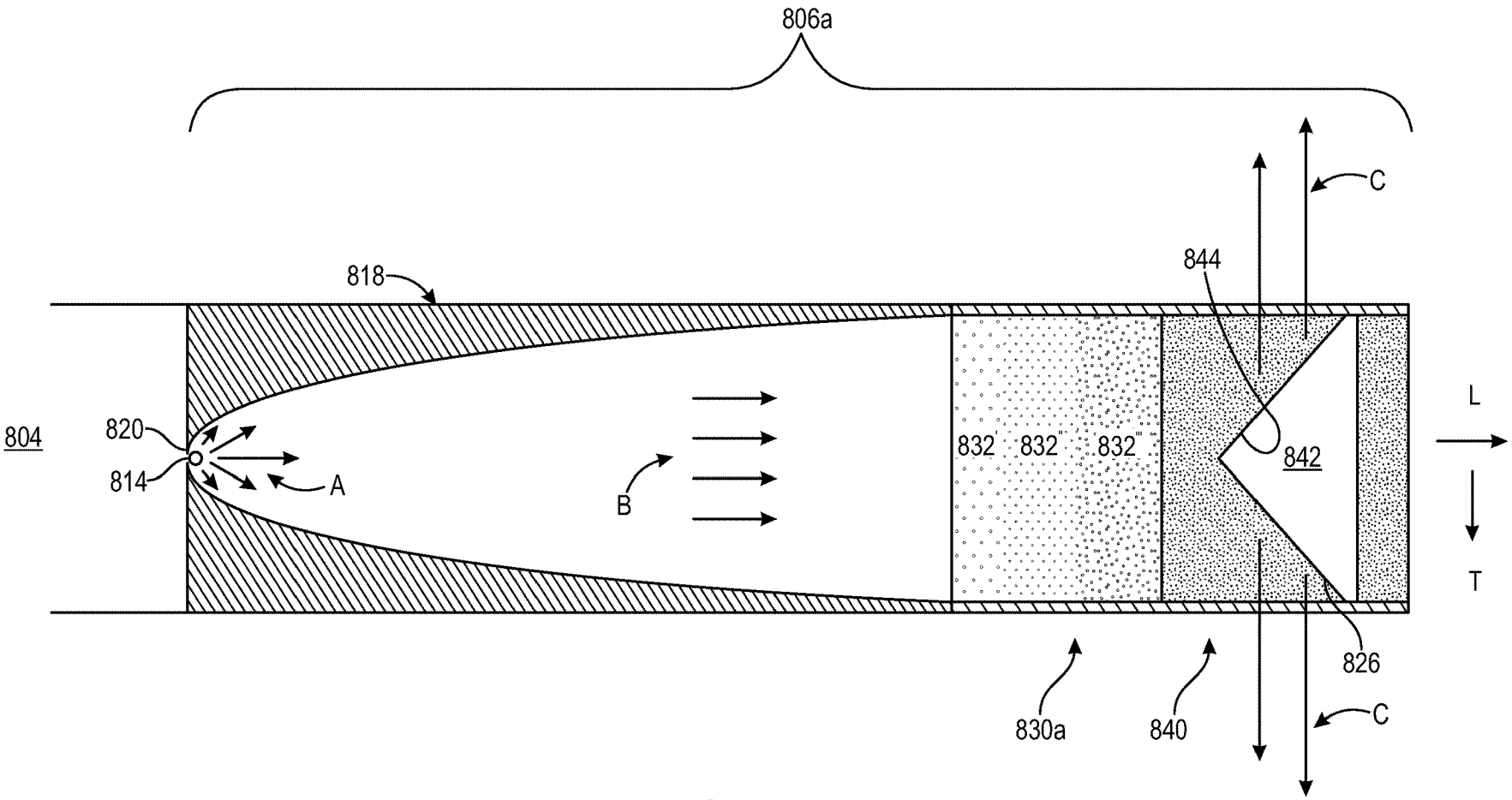
FIGS. 8A and 8B illustrate additional nonlimiting examples of an electrohydraulic fracturing device coupled to a wave manipulator.
Figure 8B:
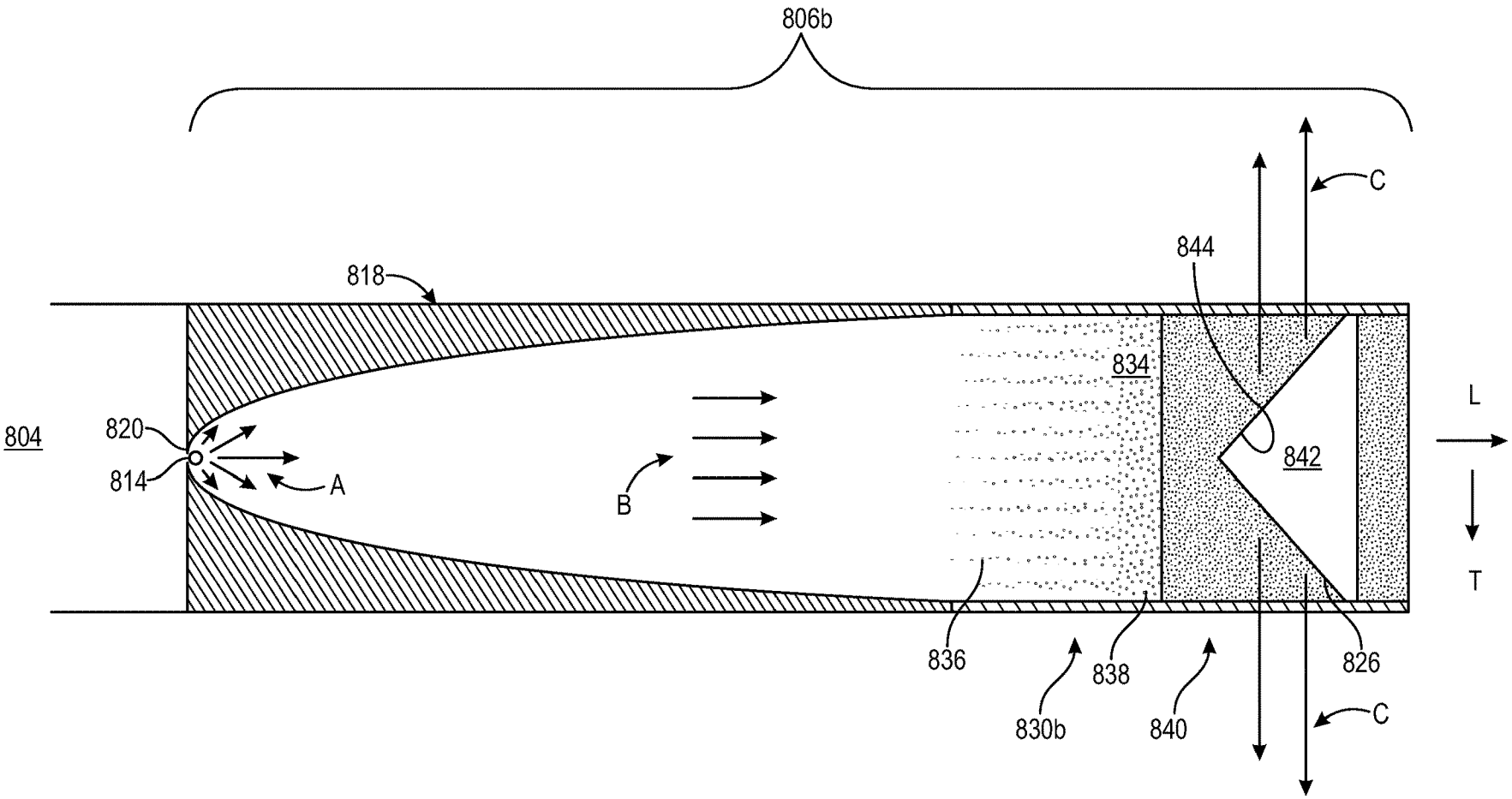

FIGS. 8A and 8B illustrate nonlimiting examples of an electrohydraulic fracturing device 804 coupled to a wave manipulator 806*a* or 806*b*, respectively. In these examples, the wave manipulator 806 manipulates the acoustic shock wave 814 by (a) changing the shape of the acoustic shock wave 814, (b) changing the acoustic impedance of the acoustic shock wave 814, and (c) converting the compressive wave character of the acoustic shock wave 814 to an expansion wave character. The wave manipulator 806 then distributes a modified shock wave to the surrounding area (e.g., the formation).

FIG. 8A illustrates a wave manipulator 806*a* includes a wave-focusing component 818 having an opening 820 at first end proximal to the electrohydraulic fracturing device 804. The wave-focusing component 818 functions as described for the wave-focusing component 218 of FIG. 2.

The acoustic shock wave 814 having a quasi-planar shape traveling in direction B then interacts with an acoustic impedance conversion component 830*a* that comprises layers 832', 832", 832'" of materials where the acoustic impedance of said materials are layer 832'<layer 832"<layer 832'" (e.g., as described relative to layers 632', 632", 632'" and alternative configurations thereof of FIG. 6A). The acoustic impedance conversion component 830*a* increases the acoustic impedance of the acoustic shock wave 814 as it travels through the acoustic impedance conversion component 830*a* towards a wave distribution component 826 and a wave converter component 840.

The acoustic shock wave 814 having a quasi-planar shape traveling in direction B and changed acoustic impedance then interacts with the wave converter component 840 and the wave distribution component 826. The wave converter component 840 includes a cavity 842 comprising a gas and having a solid-gas interface 844 that converts the compressive wave character of the acoustic shock wave 814 to an expansion wave character. The gas may be at greater than ambient pressure (e.g., a compressed gas), ambient pressure, or reduced pressure. The solid portion of the solid-gas interface 844 is a reflective material, which is the wave distribution component 826 that distributes a modified shock wave (having a changed shape, changed acoustic impedance, and converted wave character) to the surrounding area (e.g., the formation).

FIG. 8B illustrates a wave manipulator 806*b* includes a wave-focusing component 818 having an opening 820 at first end proximal to the electrohydraulic fracturing device 804. The wave-focusing component 818 functions as described for the wave-focusing component 218 of FIG. 2.

The acoustic shock wave 814 progressively transitions from lower to higher acoustic impedance in an acoustic impedance conversion component 830*b* that uses the structure of a material 834 having an acoustic impedance within about 20% (or within about 10%, or within about 5%) of the acoustic impedance of the casing or formation or both to progressively transition the acoustic impedance of the shock wave 814 (e.g., as described in FIG. 6B). Illustrated are tapered spikes 836 composed of the material 834 where the tips or points of the spikes are proximal to the wave-focusing component 818. The spikes 836 increase in cross-sectional area as the spikes 836 approach the wave converter component 840 and the wave distribution component 826. In the illustrated example, the spikes 836 come together at a base 838 that contacts a surface of the wave converter component 840. The acoustic impedance conversion component 830*b* increases the acoustic impedance of the acoustic shock wave 814 as it travels through the acoustic impedance conversion component 830*a* towards a wave distribution component 826 and a wave converter component 840.

The acoustic shock wave 814 having a quasi-planar shape traveling in direction B and changed acoustic impedance then interacts with the wave converter component 840 and the wave distribution component 826. The wave converter component 840 includes a cavity 842 comprising gas and having a solid-gas interface 844 that converts the compressive wave character of the acoustic shock wave 814 to an expansion wave character. The solid portion of the solid-gas interface 844 is a reflective material, which is the wave distribution component 826 that distributes a modified shock wave (having a changed shape, changed acoustic impedance, and converted wave character) to the surrounding area (e.g., the formation).

The wave manipulators described herein may include one or more of: (a) a wave-focusing component capable of channeling the acoustic shock wave; (b) an acoustic impedance conversion component capable of changing an acoustic impedance of the acoustic shock wave; (c) a wave converter component capable of converting a compressive wave character of the acoustic shock wave to an expansion wave character; and (d) a wave distribution component. The foregoing figures are nonlimiting examples of configurations of wave manipulators of the present disclosure.

The wave manipulators described herein may be used with any known electrohydraulic fracturing device with suitable adaptations to achieve proper directing of the acoustic shock wave into the wave manipulator. Such adaptations would be reasonable for those skilled in the art.

The wave manipulators described herein coupled to an electrohydraulic fracturing device may be used in electrohydraulic fracturing operations. For example, a system (comprising wave manipulators described herein coupled to an electrohydraulic fracturing device) may be placed in a wellbore penetrating a formation. The electrohydraulic fracturing operation may, for example, include producing an acoustic shock wave having a compressive wave character in a wellbore penetrating a formation; channeling the acoustic shock wave down the wellbore to change a shape of the acoustic shock wave to a quasi-planar shape (e.g., in a wave-focusing component of the wave manipulator); and distributing the acoustic shock wave having the changed shape into the formation (e.g., using a wave distribution component of the wave manipulator) to produce cracks in the formation. The acoustic shock wave distributed into the formation may have a quasi-planar wave shape. Depending on the shape of the wave distribution component, the acoustic shock wave distributed into the formation may be in the transverse direction (+/−30°) of the wellbore and wave manipulator directional and extending about 360° or less around the wave manipulator. For example, the shape of the wave distribution component in FIGS. 3A-3B provide for a 360° plane extending in a transverse direction (+/−30°) from the wave manipulator. Alternatively, the shape of the wave distribution component in FIGS. 5-5B provide for a much smaller, more directed plane extending in a transverse direction (+/−30°) from the wave manipulator. Further, other shapes and curvatures of the wave distribution component can direct the shock wave at angles between the longitudinal and transverse directions but still into the surrounding formation.

In any configuration of the wave distribution component, the wave distribution component may be rotated about the longitudinal direction (e.g., by rotating the wave distribution component, the wave manipulator, or other components of the system) within the wellbore. This allows for further directing the direction of the shock wave relative to the formation.

In another example, the electrohydraulic fracturing operation may include producing an acoustic shock wave having a compressive wave character in a wellbore penetrating a formation; channeling the acoustic shock wave down the wellbore to change a shape of the acoustic shock wave to a quasi-planar shape (e.g., in a wave-focusing component of the wave manipulator); converting the compressive wave character to an expansion wave character (e.g., using a wave converter component of the wave manipulator); and distributing the acoustic shock wave having the changed shape and the expansion wave character into the formation (e.g., using a wave distribution component of the wave manipulator) to produce cracks in the formation. Again, the shape and direction of the distributed acoustic shock wave can be according to the shape of the wave distribution component. Further, the wave distribution component may be rotated within the wellbore.

In yet another example, the electrohydraulic fracturing operation may include producing an acoustic shock wave having a compressive wave character in a wellbore penetrating a formation; channeling the acoustic shock wave down the wellbore to change a shape of the acoustic shock wave to a quasi-planar shape (e.g., in a wave-focusing component of the wave manipulator); changing an acoustic impedance of the acoustic shock wave (e.g., using an acoustic impedance conversion component of the wave manipulator); and distributing the acoustic shock wave having the changed shape and the changed acoustic impedance into the formation (e.g., using a wave distribution component of the wave manipulator) to produce cracks in the formation. Again, the shape and direction of the distributed acoustic shock wave can be according to the shape of the wave distribution component. Further, the wave distribution component may be rotated within the wellbore.

In another example, the electrohydraulic fracturing operation may include producing an acoustic shock wave having a compressive wave character in a wellbore penetrating a formation; channeling the acoustic shock wave down the wellbore to change a shape of the acoustic shock wave to a quasi-planar shape (e.g., in a wave-focusing component of the wave manipulator); changing an acoustic impedance of the acoustic shock wave (e.g., using an acoustic impedance conversion component of the wave manipulator); converting the compressive wave character to an expansion wave character (e.g., using a wave converter component of the wave manipulator); and distributing the acoustic shock wave having the changed shape, the changed acoustic impedance, and the expansion wave character into the formation (e.g., using a wave distribution component of the wave manipulator) to produce cracks in the formation. Again, the shape and direction of the distributed acoustic shock wave can be according to the shape of the wave distribution component. Further, the wave distribution component may be rotated within the wellbore.

The electrohydraulic fracturing methods described herein may be used alone or in conjunction with stimulation operations like acidizing and hydraulic fracturing, for example.

Further, other hydrocarbon operations may follow the electrohydraulic fracturing methods described herein including propping operations, production operations, and the like, and any combination thereof.

Example Embodiments

A first nonlimiting example embodiment of the present disclosure is a method comprising: producing an acoustic shock wave having a compressive wave character in a wellbore penetrating a formation; channeling the acoustic shock wave down the wellbore to change a shape of the acoustic shock wave to a quasi-planar shape; and distributing the acoustic shock wave having the changed shape into the formation. The first nonlimiting example embodiment may include one or more of: Element 1: wherein the acoustic shock wave distributed into the formation has a quasi-planar wave shape; Element 2: wherein distributing the acoustic shock wave comprises: reflecting the acoustic shock wave off of a reflective material of a wave distribution component; Element 3: Element 2 and the method further comprising: rotating the wave distribution component within the wellbore; Element 4: Element 2 and wherein the wave distribution component comprises a material selected form the group consisting of: a magnesium alloy, high-strength aluminum alloy, aluminum-lithium alloy, copper-base alloy, steel, tungsten, and any combination thereof; Element 5: the method further comprising: converting the compressive wave character to an expansion wave character; and wherein the acoustic shock wave distributed into the formation also has the expansion wave character; Element 6: Element 5 and wherein converting the compressive wave character to the expansion wave character comprises: reflecting the acoustic shock wave with the compressive wave character off of a cavity (the cavity may comprise a gas at greater than ambient pressure, ambient pressure, or reduced pressure or the cavity may comprise a vacuum); Element 7: Element 5 and the method further comprising: rotating the cavity within the wellbore; Element 8: the method further comprising: changing an acoustic impedance of the acoustic shock wave; and wherein the acoustic shock wave distributed into the formation also has the changed acoustic impedance; Element 9: Element 8 and wherein the changed acoustic impedance is closer to an acoustic impedance of the formation than an acoustic impedance of water; Element 10:

Element 8 and wherein changing the acoustic impedance of the acoustic shock wave comprises: passing the acoustic shock wave through a material having an acoustic impedance within 20% of an acoustic impedance of a subterranean formation; Element 11: Element 8 and wherein changing the acoustic impedance of the acoustic shock wave comprises: passing the acoustic shock wave through a material selected from the group consisting of a magnesium alloy, a high-strength aluminum alloy, an aluminum-lithium alloy, a copper-base alloy, a polydimethylsiloxane-titanium dioxide composite, and any combination thereof; Element 12: Element 8 and wherein changing the acoustic impedance of the acoustic shock wave comprises: progressively transitioning from lower to higher acoustic impedance along a length of an acoustic impedance conversion component; Element 13: Element 12 and wherein the acoustic impedance conversion component achieves the progressive transition with layers of materials in the acoustic impedance conversion component; and Element 14: Element 12 and wherein the acoustic impedance conversion component achieves the progressive transition with a shape of a material in the acoustic impedance conversion component. Examples of combinations include, but are not limited to, Element 1 in combination with one or more of Elements 2-14; Element 2 in combination with Elements 3 and 4; Element 2 (optionally in combination with Elements 3 and/or 4) in combination with one or more of Elements 5-14; Element 5 in combination with Elements 6 and 7; Element 5 (optionally in combination with one or more of Elements 6-7) in combination with Element 8 (optionally in combination with one or more of Elements 9-14); Element 8 in combination with one or more of Elements 9-11; and Element 8 (optionally in combination with one or more of Elements 9-11) in combination with Elements 12-14.

A second nonlimiting example embodiment of the present disclosure is a method comprising: producing an acoustic shock wave having a compressive wave character in a wellbore penetrating a formation; channeling the acoustic shock wave down the wellbore to change a shape of the acoustic shock wave to less spherical; converting the compressive wave character to an expansion wave character; changing an acoustic impedance of the acoustic shock wave; and distributing the acoustic shock wave having the changed shape, the expansion wave character, and the changed acoustic impedance into the formation. The second nonlimiting example embodiment may include one or more of: Element 15: wherein the acoustic shock wave distributed into the formation has a quasi-planar wave shape; Element 16: wherein distributing the acoustic shock wave comprises: reflecting the acoustic shock wave off of a reflective material of a wave distribution component; Element 17: Element 16 and wherein the wave distribution component comprises a material selected from the group consisting of: a magnesium alloy, high-strength aluminum alloy, aluminum-lithium alloy, copper-base alloy, steel, tungsten, and any combination thereof; Element 18: the method further comprising: rotating the wave distribution component within the wellbore; Element 19: wherein converting the compressive wave character to the expansion wave character comprises: reflecting the acoustic shock wave with the compressive wave character off of a cavity (the cavity may comprise a gas at greater than ambient pressure, ambient pressure, or reduced pressure or the cavity may comprise a vacuum); Element 20: wherein the changed acoustic impedance is closer to an acoustic impedance of the formation than an acoustic impedance of water; Element 21: wherein changing the acoustic impedance of the acoustic shock wave comprises: passing the acoustic shock wave through a material having an acoustic impedance within 20% of an acoustic impedance of a subterranean formation; Element 22: wherein changing the acoustic impedance of the acoustic shock wave comprises: passing the acoustic shock wave through a material selected from the group consisting of a magnesium alloy, a high-strength aluminum alloy, an aluminum-lithium alloy, a copper-base alloy, a polydimethylsiloxane-titanium dioxide composite, and any combination thereof; Element 23: wherein changing the acoustic impedance of the acoustic shock wave comprises: progressively transitioning from lower to higher acoustic impedance along a length of an acoustic impedance conversion component; Element 24: Element 23 and wherein the acoustic impedance conversion component achieves the progressive transition with layers of materials in the acoustic impedance conversion component; and Element 25: Element 23 and wherein the acoustic impedance conversion component achieves the progressive transition with a shape of a material in the acoustic impedance conversion component. Examples of combinations include, but are not limited to, Element 15 in combination with one or more of Elements 16-25; Element 16 (optionally in combination with Element 17) in combination with one or more of Elements 18-25; Element 18 in combination with one or more of Elements 19-25; Element 19 in combination with one or more of Elements 20-25; Element 20 in combination with one or more of Elements 21-25; Element 22 in combination with one or more of Elements 23-25; and Elements 23-25 in combination.

A third nonlimiting example embodiment of the present disclosure is a system comprising: an electrohydraulic fracturing device capable of producing an acoustic shock wave; a wave manipulator coupled to the electrohydraulic fracturing device such that the acoustic shock wave enters the manipulator, wherein the wave manipulator comprises: a wave-focusing component capable of channeling the acoustic shock wave; and a wave distribution component. The third nonlimiting example embodiment may include one or more of: Element 26: wherein the wave distribution component comprises a material selected from the group consisting of: a magnesium alloy, high-strength aluminum alloy, aluminum-lithium alloy, copper-base alloy, steel, tungsten, and any combination thereof; Element 27: wherein the wave manipulator further comprises: an acoustic impedance conversion component capable of changing an acoustic impedance of the acoustic shock wave; Element 28: Element 27 and wherein the change in the acoustic impedance is a progressive transition from lower to higher acoustic impedance occurring along a length of the acoustic impedance conversion component; Element 29: Element 28 and wherein the acoustic impedance conversion component achieves the progressive transition with layers of materials in the acoustic impedance conversion component; Element 30: Element 29 and wherein at least one of the layers of materials comprises a material having an acoustic impedance within 20% of an acoustic impedance of a subterranean formation; Element 31: Element 29 and wherein at least one of the layers of materials comprises a material selected from the group consisting of: a magnesium alloy, high-strength aluminum alloy, aluminum-lithium alloy, copper-base alloy, steel, tungsten, and any combination thereof; Element 32: Element 28 and wherein the acoustic impedance conversion component achieves the progressive transition with a shape of a material in the acoustic impedance conversion component; Element 33: Element 32 and wherein the material has an acoustic impedance within 20% of an acoustic impedance of a subterranean formation; Element 34: Element 32 and wherein the material comprises one or more of: a magnesium alloy, a high-strength aluminum alloy, an aluminum-lithium alloy, a copper-base alloy, and a polydimethylsiloxane-titanium dioxide composite; Element 35: wherein the wave manipulator further comprises: a wave converter component capable of converting a compressive wave character of the acoustic shock wave to an expansion wave character; and Element 36: Element 35 and wherein the wave converter component comprises a cavity (the cavity may comprise a gas at greater than ambient pressure, ambient pressure, or reduced pressure or the cavity may comprise a vacuum). Examples of combinations include, but are not limited to, Element 26 in combination with one or more of Elements 27-36; Element 27 in combination with Elements 29 and 32 and optionally in further combination with one or more of Elements 30, 31, 33, and 34; and Element 35 (optionally in combination with Element 36) in combination with one or more of Elements 27-34.

A fourth nonlimiting example embodiment of the present disclosure is a system comprising: an electrohydraulic fracturing device capable of producing an acoustic shock wave; a wave manipulator coupled to the electrohydraulic fracturing device such that the acoustic shock wave enters the manipulator, wherein the wave manipulator comprises: a wave-focusing component capable of channeling the acoustic shock wave; an acoustic impedance conversion component capable of changing an acoustic impedance of the acoustic shock wave; a wave converter component capable of converting a compressive wave character of the acoustic shock wave to an expansion wave character; and a wave distribution component.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the incarnations of the present inventions. At the very least, and not as an attempt to limit the application of the doctrine of equivalents to the scope of the claim, each numerical parameter should at least be construed in light of the number of reported significant digits and by applying ordinary rounding techniques.

One or more illustrative incarnations incorporating one or more invention elements are presented herein. Not all features of a physical implementation are described or shown in this application for the sake of clarity. It is understood that in the development of a physical embodiment incorporating one or more elements of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" various components or steps, the compositions and methods can also "consist essentially of" or "consist of" the various components and steps.

Therefore, the present invention is well adapted to attain the ends and advantages mentioned as well as those that are inherent therein. The particular examples and configurations disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A method comprising:

producing an acoustic shock wave having a compressive wave character in a wellbore penetrating a formation;

channeling the acoustic shock wave longitudinally down the wellbore through a cavity containing a gas to change a shape of the acoustic shock wave to a quasi-planar shape;

converting the compressive wave character to an expansion wave character, wherein the compressive wave character is converted to the expansion wave character by reflecting the acoustic shock wave with the compressive wave character off of a solid-gas interface; and distributing the acoustic shock wave having the planar shape and the expansion wave character in a transverse direction relative to the wellbore and into the formation.

2. The method of claim 1, wherein distributing the acoustic shock wave comprises:

reflecting the acoustic shock wave off of a reflective material of a wave distribution component.

3. The method of claim 2, further comprising:

rotating the wave distribution component within the wellbore.

4. The method of claim 1, further comprising:

rotating the cavity within the wellbore.

5. A method comprising:

producing a spherically radiating acoustic shock wave having a compressive wave character in a wellbore penetrating a formation;

channeling the acoustic shock wave longitudinally down the wellbore to change a shape of the acoustic shock wave to less spherical;

converting the compressive wave character to an expansion wave character;

wherein the compressive wave character is converted to the expansion wave character by reflecting the acoustic shock wave with the compressive wave character off of a solid-gas interface;

changing an acoustic impedance of the acoustic shock wave; and distributing the acoustic shock wave having the changed shape, the expansion wave character, and the changed acoustic impedance in a transverse direction relative to the wellbore and into the formation.

6. The method of claim 5, wherein the changed acoustic impedance is closer to an acoustic impedance of the formation than an acoustic impedance of water.

7. The method of claim 5, wherein changing the acoustic impedance of the acoustic shock wave comprises:

passing the acoustic shock wave through a material selected from the group consisting of a magnesium alloy, a high-strength aluminum alloy, an aluminum-lithium alloy, a copper-base alloy, a polydimethylsiloxane-titanium dioxide composite, and any combination thereof.

8. The method of claim 5, changing the acoustic impedance of the acoustic shock wave comprises:

progressively transitioning from lower to higher acoustic impedance along a length of an acoustic impedance conversion component.

9. The method of claim 8, wherein the acoustic impedance conversion component achieves the progressive transition with layers of materials in the acoustic impedance conversion component.

10. The method of claim 8, wherein the acoustic impedance conversion component achieves the progressive transition with a shape of a material in the acoustic impedance conversion component.

11. A system comprising:

an electrohydraulic fracturing device capable of producing an acoustic shock wave;

a wave manipulator coupled to the electrohydraulic fracturing device such that the acoustic shock wave enters the manipulator, wherein the wave manipulator comprises:

a wave-focusing component containing a gas, the wave-focusing component being capable of channeling the acoustic shock wave along a longitudinal direction of the wave manipulator;

a wave converter component comprising a reflective solid-gas interface and capable of converting a compressive wave character of the acoustic shock wave to an expansion character; and a wave distribution component capable of receiving the acoustic shock wave from the wave-focusing component and distributing the acoustic shock wave in a transverse direction of the wave manipulator.

12. The system of claim 11, wherein the wave manipulator further comprises:

an acoustic impedance conversion component capable of changing an acoustic impedance of the acoustic shock wave.

13. The system of claim 12, wherein the change in the acoustic impedance is a progressive transition from lower to higher acoustic impedance occurring along a length of the acoustic impedance conversion component.

14. The system of claim 13, wherein the acoustic impedance conversion component achieves the progressive transition with layers of materials in the acoustic impedance conversion component.

15. The system of claim 13, wherein the acoustic impedance conversion component achieves the progressive transition with a shape of a material in the acoustic impedance conversion component.

16. The system of claim 11, wherein the wave distribution component is rotatable.

17. The system of claim 11, wherein the wave manipulator further comprises:

a channel; and a cavity containing gas, wherein the channel is capable of channeling the acoustic wave shock longitudinally through the cavity to change a shape of the acoustic wave to less spherical.

18. The system of claim 17, wherein the cavity is rotatable.

* * * * *